US010774506B2

(12) United States Patent
Wei

(10) Patent No.: US 10,774,506 B2
(45) Date of Patent: Sep. 15, 2020

(54) SYSTEM AND METHOD FOR CONTROLLING THE OPERATION OF A MACHINE

(71) Applicant: Caterpillar Inc., Deerfield, IL (US)

(72) Inventor: Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 167 days.

(21) Appl. No.: 16/145,992

(22) Filed: Sep. 28, 2018

(65) Prior Publication Data

US 2020/0102721 A1 Apr. 2, 2020

(51) Int. Cl.

| | |
|---|---|
| ***E02F 9/26*** | (2006.01) |
| ***E02F 3/76*** | (2006.01) |
| ***E02F 3/84*** | (2006.01) |
| *E02F 9/20* | (2006.01) |

(52) U.S. Cl.

CPC ..... *E02F 9/262* (2013.01); *E02F 3/7618* (2013.01); *E02F 3/842* (2013.01); *E02F 3/845* (2013.01); *E02F 9/205* (2013.01)

(58) Field of Classification Search

CPC ..... E02F 9/262; E02F 3/7618; E02F 3/842; E02F 3/845; E02F 9/205

USPC ..... 701/50

See application file for complete search history.

(56) References Cited

U.S. PATENT DOCUMENTS

| | | | |
|---|---|---|---|
| 4,290,651 | A | 9/1981 | Files et al. |
| 5,140,907 | A | 8/1992 | Svatek |
| 5,194,689 | A | 3/1993 | Cummins |
| 5,551,524 | A | 9/1996 | Yamamoto et al. |
| 5,864,970 | A | 2/1999 | Maddock et al. |
| 5,924,493 | A | 7/1999 | Hartman et al. |
| 5,944,764 | A | 8/1999 | Henderson et al. |
| 6,085,130 | A | 7/2000 | Brandt et al. |
| 6,167,336 | A | 12/2000 | Singh et al. |
| 6,363,632 | B1 | 4/2002 | Stentz et al. |
| 6,445,310 | B1 | 9/2002 | Bateman et al. |
| 6,845,311 | B1 | 1/2005 | Stratton et al. |
| 7,216,033 | B2 | 5/2007 | Flann et al. |
| 7,578,079 | B2 | 8/2009 | Furem |

(Continued)

FOREIGN PATENT DOCUMENTS

| | | | |
|---|---|---|---|
| EP | 2353353 | A1 | 8/2011 |
| WO | WO 2018/039709 | A1 | 3/2018 |

*Primary Examiner* — Gertrude Arthur Jeanglaude

(74) *Attorney, Agent, or Firm* — Leydig, Voit & Mayer, Ltd.

(57) ABSTRACT

A system for moving material with a ground engaging work implement determines a topography of the work surface, a maximum cutting capacity for a cutting operation, and a maximum carrying capacity for a carrying operation. A first double cut location is determined based upon the maximum carrying capacity and the topography of the work surface and a second double cut location is determined based upon the maximum carrying capacity and a modified topography of the work surface. Individually, the amount of material from each of the first and second double cut locations is less than the maximum cutting capacity, and combined is less than the maximum carrying capacity. A first forward double cut command moves the first double cut material to an intermediate position and a second forward double cut command moves the first double cut material and the second double cut amount of material to a dump location.

20 Claims, 10 Drawing Sheets

(56) References Cited

U.S. PATENT DOCUMENTS

| | | | |
|---|---|---|---|
| 7,734,398 | B2 | 6/2010 | Manneppalli |
| 7,979,175 | B2 | 7/2011 | Allard et al. |
| 8,073,584 | B2 | 12/2011 | Marty et al. |
| 8,139,108 | B2 | 3/2012 | Stratton et al. |
| 8,144,245 | B2 | 3/2012 | Vik |
| 8,315,789 | B2 | 11/2012 | Dunbabin et al. |
| 8,351,684 | B2 | 1/2013 | Clar et al. |
| 8,456,327 | B2 | 6/2013 | Bechtel et al. |
| 8,620,535 | B2 | 12/2013 | Friend et al. |
| 9,014,922 | B2 | 4/2015 | Edara et al. |
| 9,760,081 | B2 | 9/2017 | Taylor et al. |
| 9,783,955 | B1 | 10/2017 | Clar et al. |
| 2007/0129869 | A1 | 6/2007 | Gudat et al. |
| 2008/0180523 | A1 | 7/2008 | Stratton et al. |
| 2009/0043462 | A1 | 2/2009 | Stratton et al. |
| 2009/0202109 | A1 | 8/2009 | Clar |
| 2010/0250023 | A1 | 9/2010 | Gudat |
| 2011/0093171 | A1 | 4/2011 | Saposnik |
| 2012/0089293 | A1 | 4/2012 | Haider et al. |
| 2012/0136508 | A1 | 5/2012 | Taylor et al. |
| 2012/0139325 | A1 | 6/2012 | Norberg et al. |
| 2012/0154572 | A1 | 6/2012 | Stratton et al. |
| 2012/0215378 | A1 | 8/2012 | Sprock et al. |
| 2013/0006484 | A1 | 1/2013 | Avitzur et al. |
| 2013/0311031 | A1 | 11/2013 | Friend et al. |
| 2014/0012404 | A1 | 1/2014 | Taylor et al. |
| 2014/0032030 | A1 | 1/2014 | Stratton et al. |
| 2014/0032058 | A1 | 1/2014 | Stratton et al. |
| 2014/0032132 | A1 | 1/2014 | Stratton et al. |
| 2014/0174770 | A1* | 6/2014 | Wei ..... E02F 9/2045 172/2 |
| 2016/0076222 | A1 | 3/2016 | Taylor et al. |
| 2016/0077513 | A1 | 3/2016 | Wei et al. |
| 2017/0284200 | A1 | 10/2017 | Hall et al. |
| 2018/0163376 | A1* | 6/2018 | Redenbo ..... E02F 9/262 |

* cited by examiner

SYSTEM AND METHOD FOR CONTROLLING THE OPERATION OF A MACHINE

TECHNICAL FIELD

This disclosure relates generally to controlling a machine and, more particularly, to a system and method for analyzing elevation differences between adjacent slots in a work surface and providing the elevation differences exceeding one or more thresholds.

BACKGROUND

Machines such as dozers, motor graders, wheel loaders, etc., are used to perform a variety of tasks. For example, these machines may be used to move material at a work site. The machines may operate in an autonomous, semi-autonomous, or manual manner to perform these tasks in response to commands generated as part of a work plan for the machines. The machines may receive instructions in accordance with the work plan to perform operations including digging, loosening, carrying, etc., different materials at the work site such as those related to mining, earthmoving and other industrial activities.

Autonomously operated machines may remain consistently productive without regard to a human operator or environmental conditions. In addition, autonomous systems may permit operation in environments that are unsuitable or undesirable for a human operator. Autonomous or semi-autonomous systems may also compensate for inexperienced human operators as well as inefficiencies associated with repetitive tasks.

When performing slot dozing operations, adjacent slots may have lower surfaces at substantially different heights. Accordingly, if a machine does not accurately follow the path of its slot and begins to enter an adjacent slot, the machine may pass through the berm between slots and tip over or contact the berm and become buried in material. The risk of either scenario increases when the machine is operating in an autonomous or semi-autonomous manner.

U.S. Pat. No. 9,783,955 discloses a system for moving material with a machine utilizing two different types of material moving operations. The first material moving operation is used to fill a void to a predetermined extent and the second material moving operation is used after the void is filled to the predetermined extent.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for moving material with a machine at a work site with a ground engaging work implement along a path from a first work area to a dump location includes a position sensor and a controller. The position sensor is configured to generate position signals indicative of a position of a work surface. The controller is configured to receive position signals from the position sensor, determine a topography of the work surface based upon the position signals, determine a maximum cutting capacity for a cutting operation between the work surface and a target surface beneath the work surface, and determine a maximum carrying capacity for a carrying operation along a carry surface from an end of a loading profile to the dump location. The controller is further configured to determine a first double cut location of a double cut operation along the work surface based upon the maximum carrying capacity and the topography of the work surface, with the first double cut location, the topography, and a first loading profile defining a first double cut amount of material to be moved and determine a second double cut location of the double cut operation based upon the maximum carrying capacity and a modified topography of the work surface, the modified topography of the work surface being based upon the first double cut location and the topography of the work surface, with the second double cut location, the modified topography, and a second loading profile defining a second double cut amount of material to be moved, and each of the first double cut amount of material and the second double cut amount of material is less than the maximum cutting capacity between the work surface and the target surface, and the first double cut amount of material plus the second double cut amount of material is less than the maximum carrying capacity along the carry surface. The controller is also configured to generate a first forward command to move the ground engaging work implement along the path and the first loading profile from the first double cut location and only partway towards the dump location to an intermediate position between the first double cut location and the dump location to move the first double cut amount of material to the intermediate position, generate a first reverse command to move the machine along the path to align the ground engaging work implement with the second double cut location, and generate a second forward command to move the ground engaging work implement along the path and the second loading profile from the second double cut location to the dump location to move the first double cut amount of material and the second double cut amount of material to the dump location.

In another aspect, a method is provided for moving material with a machine at a work site with a ground engaging work implement wherein the machine moves on a work surface along a path from a first work area to a dump location. The method includes receiving position signals from a position sensor, determining a topography of the work surface based upon the position signals, determining a maximum cutting capacity for a cutting operation between the work surface and a target surface beneath the work surface, and determining a maximum carrying capacity for a carrying operation along a carry surface from an end of a loading profile to the dump location. The method further includes determining a first double cut location of a double cut operation along the work surface based upon the maximum carrying capacity and the topography of the work surface, with the first double cut location, the topography, and a first loading profile defining a first double cut amount of material to be moved, determining a second double cut location of the double cut operation based upon the maximum carrying capacity and a modified topography of the work surface, the modified topography of the work surface being based upon the first double cut location and the topography of the work surface, with the second double cut location, the modified topography, and a second loading profile defining a second double cut amount of material to be moved, and each of the first double cut amount of material and the second double cut amount of material being less than the maximum cutting capacity between the work surface and the target surface, and the first double cut amount of material plus the second double cut amount of material being less than the maximum carrying capacity along the carry surface. The method also includes generating a first forward command to move the ground engaging work implement along the path and the first loading profile from the first double cut location and only partway towards the dump location to an intermediate position between the first double cut location and the dump location to move the first double cut amount of material to the intermediate position, generating a first reverse command to move the machine along the path to align the ground engaging work implement with the second double cut location, and generating a second forward command to move the ground engaging work implement along the path and the second loading profile from the second double cut location to the dump location to move the first double cut amount of material and the second double cut amount of material to the dump location.

In still another aspect, a machine includes a prime mover, a ground-engaging work implement for engaging a work surface along a path, a position sensor, and a controller. The position sensor is configured to generate position signals indicative of a position of a work surface. The controller is configured to receive position signals from the position sensor, determine a topography of the work surface based upon the position signals, determine a maximum cutting capacity for a cutting operation between the work surface and a target surface beneath the work surface, and determine a maximum carrying capacity for a carrying operation along a carry surface from an end of a loading profile to the dump location. The controller is further configured to determine a first double cut location of a double cut operation along the work surface based upon the maximum carrying capacity and the topography of the work surface, with the first double cut location, the topography, and a first loading profile defining a first double cut amount of material to be moved and determine a second double cut location of the double cut operation based upon the maximum carrying capacity and a modified topography of the work surface, the modified topography of the work surface being based upon the first double cut location and the topography of the work surface, with the second double cut location, the modified topography, and a second loading profile defining a second double cut amount of material to be moved, and each of the first double cut amount of material and the second double cut amount of material is less than the maximum cutting capacity between the work surface and the target surface, and the first double cut amount of material plus the second double cut amount of material is less than the maximum carrying capacity along the carry surface. The controller is also configured to generate a first forward command to move the ground engaging work implement along the path and the first loading profile from the first double cut location and only partway towards the dump location to an intermediate position between the first double cut location and the dump location to move the first double cut amount of material to the intermediate position, generate a first reverse command to move the machine along the path to align the ground engaging work implement with the second double cut location, and generate a second forward command to move the ground engaging work implement along the path and the second loading profile from the second double cut location to the dump location to move the first double cut amount of material and the second double cut amount of material to the dump location.

DETAILED DESCRIPTION

Figure 1:
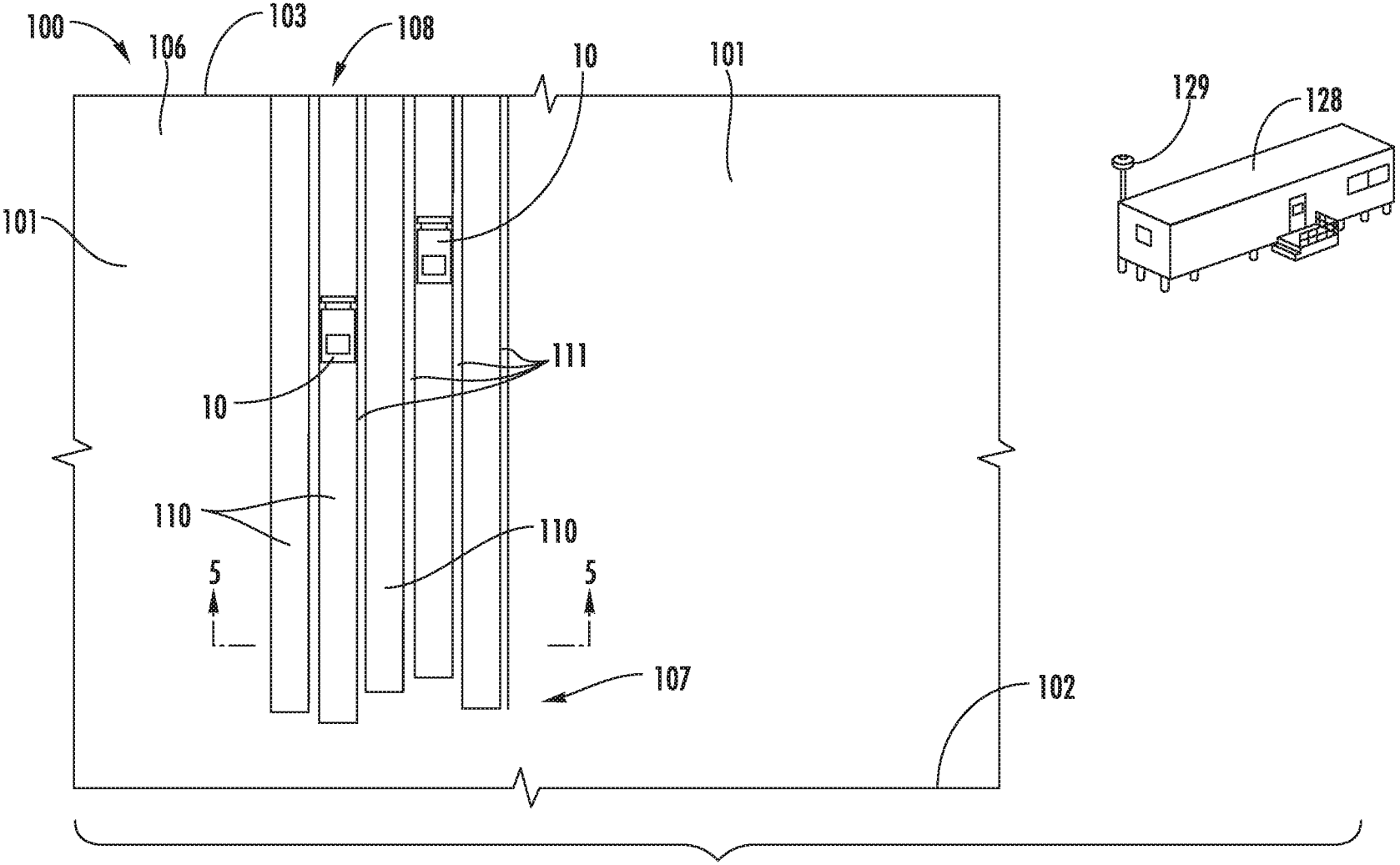
FIG. 1 depicts a schematic view of a work site at which a machine incorporating the principles disclosed herein may be used.

FIG. 1 depicts a diagrammatic illustration of a work site 100 at which one or more machines 10 may operate in an autonomous, a semi-autonomous, or a manual manner. Work site 100 may be a portion of a mining site, a landfill, a quarry, a construction site, or any other area in which movement of material is desired. Tasks associated with moving material may include a dozing operation, a grading operation, a leveling operation, a bulk material removal operation, or any other type of operation that results in the alteration of the existing topography at work site 100. As depicted, work site 100 includes a first work area 101 having a high wall 102 at one end and a crest 103 such as an edge of a ridge, embankment, or other change in elevation at an opposite end. Material is moved generally from the high wall 102 towards the crest 103. The work surface 104 of the work area 101 may take any form and refers to the actual profile or position of the terrain of the work area. A second work area 101 is depicted at an angle to the first work area.

As used herein, a machine 10 operating in an autonomous manner operates automatically based upon information received from various sensors without the need for human operator input. As an example, a haul or load truck that automatically follows a path from one location to another and dumps a load at an end point may be operating autonomously. A machine operating semi-autonomously includes an operator, either within the machine or remotely, who performs some tasks or provides some input and other tasks are performed automatically and may be based upon information received from various sensors. As an example, a load truck that automatically follows a path from one location to another but relies upon an operator command to dump a load may be operating semi-autonomously. In another example of a semi-autonomous operation, an operator may dump a bucket of an excavator in a load truck and a controller may automatically return the bucket to a position to perform another digging operation. A machine being operated manually is one in which an operator is controlling all or essentially all of the functions of the machine. A machine may be operated remotely by an operator (i.e., remote control) in either a manual or semi-autonomous manner. In some operations, a plurality of machines 10 may be configured to be operated autonomously or semi-autonomously and one or more operators responsible for overseeing the operation of the machines. At times, an operator may manually take over responsibility for the operation of one or more of the machines.

Figure 2:
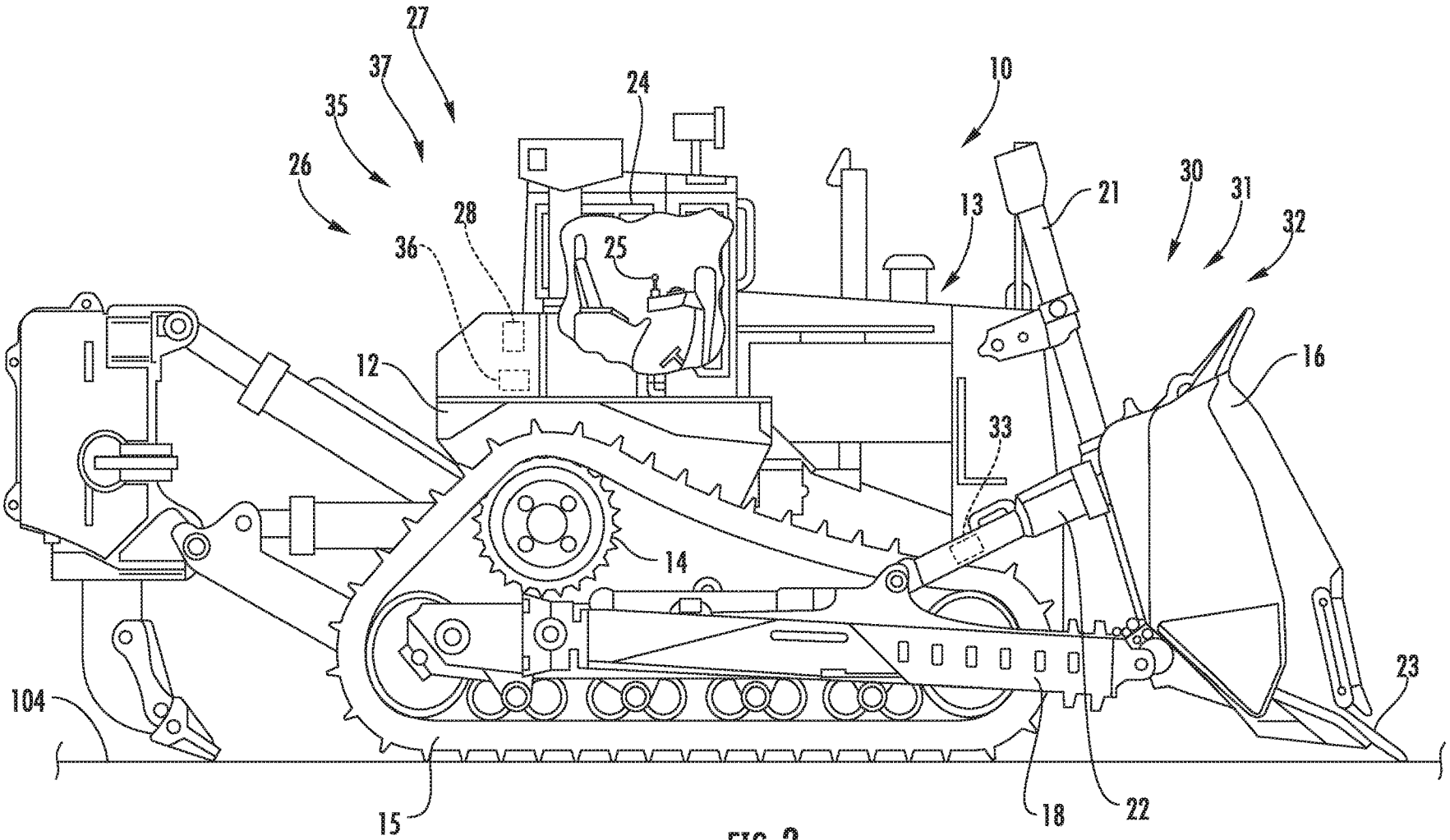
FIG. 2 depicts a diagrammatic illustration of a machine in accordance with the disclosure.

FIG. 2 depicts a diagrammatic illustration of a machine 10 such as a dozer with a ground-engaging work implement such as a blade 16 configured to push material. The machine 10 includes a frame 12 and a prime mover such as an engine 13. A ground-engaging drive mechanism such as a track 15 may be driven by a drive sprocket 14 on opposite sides of machine 10 to propel the machine. Although machine 10 is shown in a "track-type" configuration, other configurations, such as a wheeled configuration, may be used. Operation of the engine 13 and a transmission (not shown), which are operatively connected to the drive sprockets 14 and tracks 15, may be controlled by a control system 35 including a controller 36. The systems and methods of the disclosure may be used with any machine propulsion and drivetrain mechanisms applicable in the art for causing movement of the machine including hydrostatic, electric, or mechanical drives.

Blade 16 may be pivotally connected to frame 12 by arms 18 on each side of machine 10. First hydraulic cylinder 21 coupled to frame 12 supports blade 16 in the vertical direction and allows blade 16 to move up or down vertically from the point of view of FIG. 2. Second hydraulic cylinders 22 on each side of machine 10 allow the pitch angle of blade tip 23 to change relative to a centerline of the machine.

Machine 10 may include a cab 24 that an operator may physically occupy and provide input to control the machine. Cab 24 may include one or more input devices such as joystick 25 through which the operator may issue commands to control the propulsion system and steering system of the machine as well as operate various implements associated with the machine.

Machine 10 may be controlled by a control system 35 as shown generally by an arrow in FIG. 2 indicating association with the machine 10. The control system 35 may include an electronic control module or controller 36 and a plurality of sensors. The controller 36 may receive input signals from an operator operating the machine 10 from within cab 24 or off-board the machine through a wireless communications system 129. The controller 36 may control the operation of various aspects of the machine 10 including the drivetrain and the hydraulic systems.

The controller 36 may be an electronic controller that operates in a logical fashion to perform operations, execute control algorithms, store and retrieve data and other desired operations. The controller 36 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 36 such as power supply circuitry, signal conditioning circuitry, driver circuitry, and other types of circuitry.

The controller 36 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 36 may be implemented in hardware and/or software without regard to the functionality. The controller 36 may rely on one or more data maps relating to the operating conditions and the operating environment of the machine 10 and the work site 100 that may be stored in the memory of controller. Each of these data maps may include a collection of data in the form of tables, graphs, and/or equations.

The control system 35 and the controller 36 may be located on the machine 10 and may also include components located remotely from the machine such as at a command center 128 (FIG. 1). The functionality of control system 35 may be distributed so that certain functions are performed at machine 10 and other functions are performed remotely. In such case, the control system 35 may include a communications system such as wireless communications system 129 for transmitting signals between the machine 10 and a system located remote from the machine.

Machine 10 may be configured to be operated autonomously, semi-autonomously, or manually. When operating semi-autonomously or manually, the machine 10 may be operated by remote control and/or by an operator physically located within the cab 24.

Machine 10 may be equipped with a plurality of machine sensors 26, as shown generally by an arrow in FIG. 2 indicating association with the machine 10, that provide data indicative (directly or indirectly) of various operating parameters of the machine and/or the operating environment in which the machine is operating. The term "sensor" is meant to be used in its broadest sense to include one or more sensors and related components that may be associated with the machine 10 and that may cooperate to sense various functions, operations, and operating characteristics of the machine and/or aspects of the environment in which the machine is operating.

A machine position sensing system 27, as shown generally by an arrow in FIG. 2 indicating association with the machine 10, may include a machine position sensor 28, also shown generally by an arrow in FIG. 2 to indicate association with the machine, to sense the position and orientation (i.e., the heading, pitch, roll or tilt, and yaw) of the machine relative to the work site 100. The position and orientation of the machine 10 are sometimes collectively referred to as the position of the machine. The machine position sensor 28 may include a plurality of individual sensors that cooperate to generate and provide a plurality of machine position signals to controller 36 indicative of the position and orientation of the machine 10. In one example, the machine position sensor 28 may include one or more sensors that interact with a positioning system such as a global navigation satellite system or a global positioning system to operate as a position sensor. In another example, the machine position sensor 28 may further include a slope or inclination sensor such as pitch angle sensor for measuring the slope or inclination of the machine 10 relative to a ground or earth reference. The controller 36 may use machine position signals from the machine position sensors 28 to determine the position of the machine 10 within work site 100. In other examples, the machine position sensor 28 may include an odometer or another wheel rotation sensing sensor, a perception based system, or may use other systems such as lasers, sonar, or radar to determine all or some aspects of the position of machine 10.

In some embodiments, the machine position sensing system 27 may include a separate orientation sensing system. In other words, a position sensing system may be provided for determining the position of the machine 10 and a separate orientation sensing system may be provided for determining the orientation of the machine.

If desired, the machine position sensing system 27 may also be used to determine a ground speed of machine 10. Other sensors or a dedicated ground speed sensor may alternatively be used to determine the ground speed of the machine 10.

In addition, the machine position sensing system 27 may also be used to determine the elevation or topography of the work surface upon which the machine 10 is moving. More specifically, based upon known dimensions of the machine 10 and the elevation of the machine at the work site 100, the elevation or topography of the work surface may also be determined. As a result, the machine position sensing system 27 may operate as either or both of a machine position sensing system and a work surface elevation or topography sensing system. Similarly, the machine position sensor 28 may operate as either or both of a machine position sensor and a work surface elevation or topography sensor. When operating as an elevation or topography sensor, the machine position sensor 28 may generate elevation signals that are interpreted by the controller 36 to determine the relevant elevation or topography. Other sensors or a dedicated work surface position sensor may alternatively be used to determine the elevation or topography of the work surface.

The control system 35 may include an additional system such as a change in terrain detection system 30 shown generally by an arrow in FIG. 2 indicating association with the machine 10. One type of change in terrain detection system 30 that may be used to sense a crest at the work site 100 may be an implement load monitoring system 31 shown generally by an arrow in FIG. 2. The implement load monitoring system 31 may include any of a variety of different types of implement load sensors depicted generally by an arrow in FIG. 2 as an implement load sensor system 32 to measure the load on the ground engaging work implement or blade 16. For example, as blade 16 of machine 10 moves material over a crest, the load on the blade will be reduced. Accordingly, the implement load sensor system 32 may be utilized to measure or monitor the load on the blade 16 and a decrease in load may be registered by the controller 36 as a change in terrain due to the machine 10 being adjacent the crest. In other instances, an increase in load may indicate an incline or the machine 10 encountering a pile of material. In other words, the controller 36 may determine a change in terrain based at least in part upon a change in the load on blade 16.

In one embodiment, the implement load sensor system 32 may embody one or more pressure sensors 33 for use with one or more hydraulic cylinders, such as second hydraulic cylinders 22, associated with blade 16. Signals from the pressure sensor 33 indicative of the pressure within the second hydraulic cylinders 22 may be monitored by controller 36. Upon receipt of a signal indicating a substantial reduction in pressure within the second hydraulic cylinders 22, the controller 36 may determine that the load on blade 16 has been substantially reduced due to the material having been pushed over a crest. Other manners of determining a reduction in cylinder pressure associated with a reduction in the load on blade 16 are contemplated, including other manners of measuring the pressure within second hydraulic cylinders 22 and measuring the pressure within other cylinders associated with the blade. An increase in pressure indicative of an increase in load may be determined in a similar manner.

Other manners of determining changes in terrain are contemplated including the use of perception systems, acceleration sensor, and monitoring changes in engine speed relative to torque converter speed.

Machine 10 may be configured to move material at the work site 100 according to one or more material movement plans along a path 117 from a first location 107 to a second spread or dump location 108. The dump location 108 is typically but not always located downhill from the first location. The dump location 108 may be at crest 103 or at any other location. The material movement plans may include, among other things, forming a plurality of spaced apart channels or slots 110 that are cut into the work surface 104 at work site 100 along a path from the first location 107 to the dump location 108. In doing so, each machine 10 may move back and forth along a path 117 (FIG. 3) between the first location 107 and the dump location 108. If desired, a relatively small amount of material may be left or built up as walls or berms 111 between adjacent slots 110 to prevent or reduce spillage and increase the efficiency of the material moving process.

Figure 3:
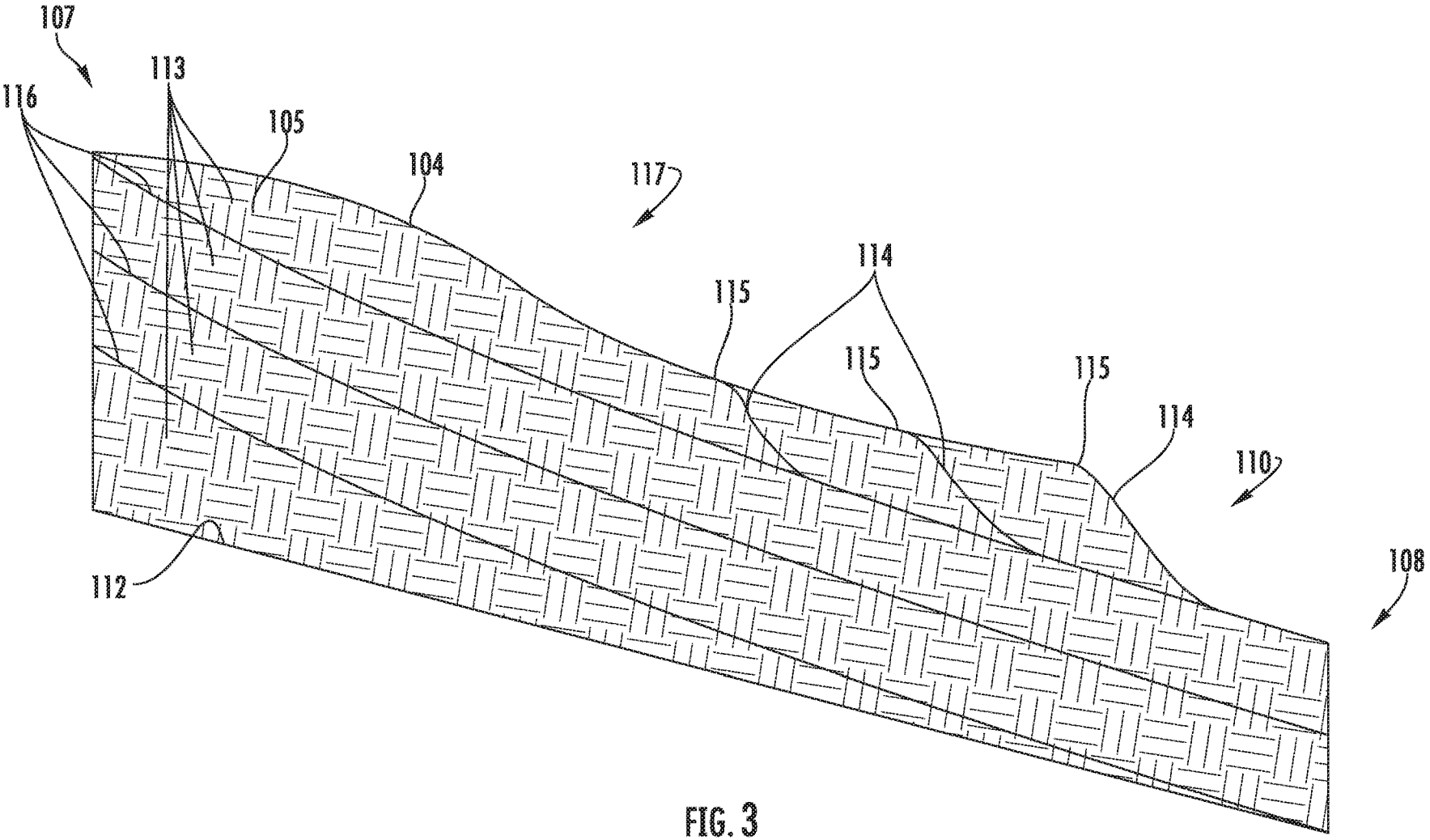
FIG. 3 depicts a diagrammatic cross-section of a portion of a work site illustrating various aspects of a material moving plan.

As depicted in FIG. 3, in one embodiment, each slot 110 may be formed by removing material 105 from the work surface 104 in one or more layers 113 until the final work surface or final design plane 112 is reached. The blade 16 of machine 10 may engage the work surface 104 with a series of cuts 114 that are spaced apart lengthwise along the slot 110. Each cut 114 begins at a cut location 115 along the work surface 104 at which the blade 16 engages the work surface and extends into the material 105 and moves towards the target surface 116 for a particular layer. As used herein, the work surface 104 along a slot prior to beginning to move material along that layer 113 is referred to as the initial surface. The target or desired position or elevation down to which material is to be cut for each layer 113 is referred to as the target surface and is beneath the work surface 104. In many operations, the cut locations 115 begin at a location closest to the dump location 108 and are moved progressively back or uphill towards the first location 107. Thus, as depicted in FIG. 3, material is moved by performing a plurality of cut operations at sequential cut locations 115 from right to left.

Figure 4:
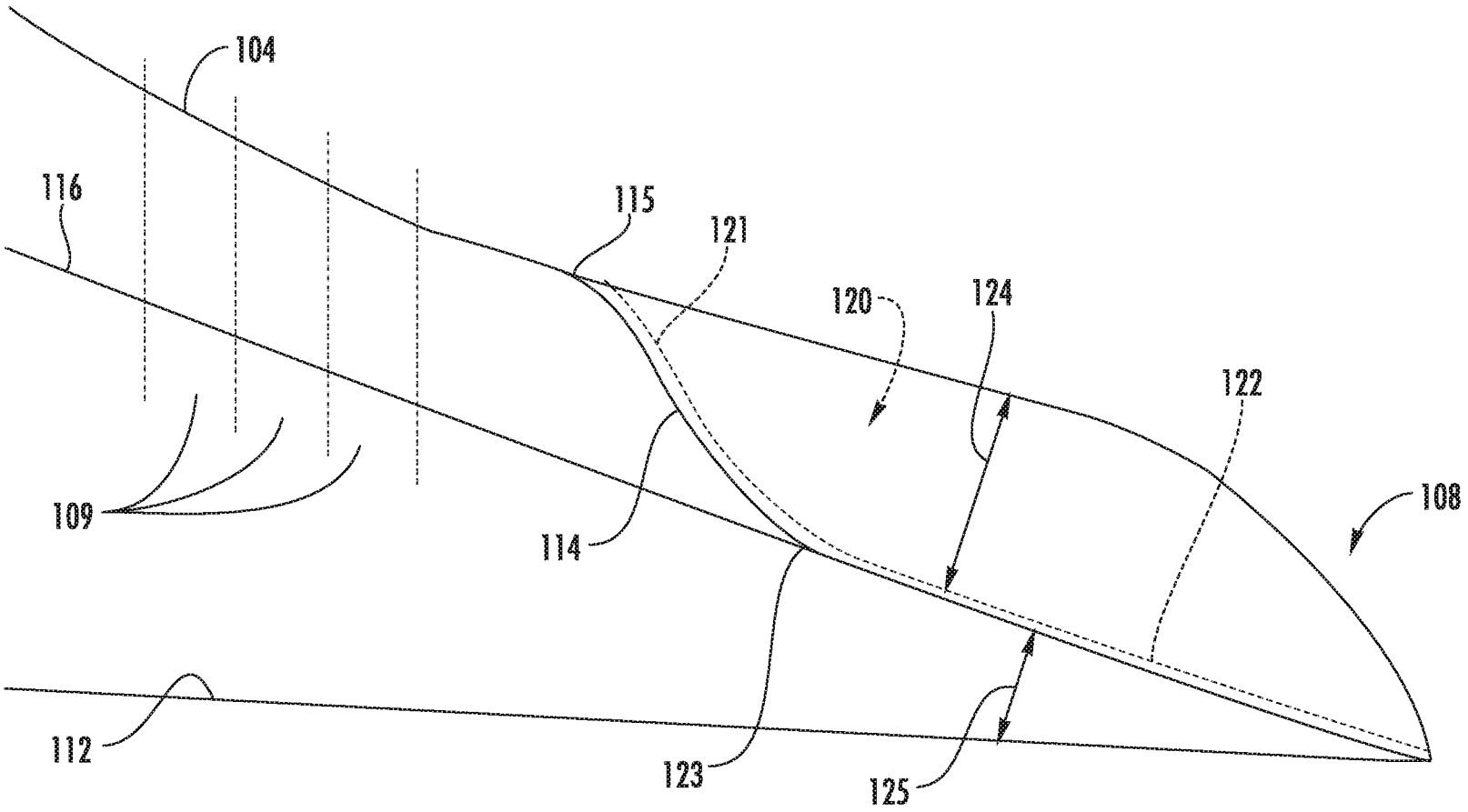
FIG. 4 depicts a diagrammatic cross-section of a portion of a work site illustrating a potential target profile.

Controller 36 may be configured to guide the blade 16 along each cut 114 beginning at the initial surface and continuing until reaching the target surface 116 and then follow the target surface (which then functions as a carry surface) towards the dump location 108. Referring to FIG. 4, during each material moving pass, the controller 36 may guide the blade 16 generally along a desired path or target profile depicted by dashed line 120 from the cut location 115 to the dump location 108. A first portion of the target profile 120 extends from the cut location 115 to the target surface 116. The first portion may be referred to as the loading profile 121 as that is the portion of the target profile 120 at which the blade 16 is initially loaded with material. A second portion of the target profile 120 extends from the intersection 123 of the cut 114 and the target surface 116 (which corresponds to the end of the loading profile) to the dump location 108. The second portion may be referred to as the carry profile 122 as that is the portion of the target profile 120 at which the blade 16 carries the load along the target surface 116.

The first portion or loading profile 121 may have any configuration and, depending on various factors including the configuration of the work surface 104 and the type of material to be moved, some cut profiles may be more efficient than others. The loading profile 121 may be formed of one or more segments that are equal or unequal in length and with each having different or identical shapes. These shapes may be linear, symmetrically or asymmetrically curved, Gaussian-shaped or any other desired shape. In addition, the angle of any of the shapes relative to the work surface 104 or the final design plane 112 may change from segment to segment.

The second portion or carry profile 122 may have any configuration but is often generally linear and sloped downward so that movement of material will be assisted by gravity to increase the efficiency of the material moving process. In other words, the carry profile 122 is often configured so that it slopes downward towards the dump location 108. The characteristics of the carry profile 122 (sometimes referred to as the slot parameters) may include the shape of the target surface 116, the depth of the target surface below the current uppermost or initial surface of the work surface 104 as indicated by reference number 124, and the angle of the target surface as indicated by reference number 125. In some instances, the angle 125 of the target surface 116 may be defined relative to a gravity reference or relative to the final design plane 112.

As used herein, the word "uphill" refers to a direction towards the high wall 102 relative to the crest 103 or dump location 108. Similarly, the word "downhill" refers to a direction towards the crest 103 or dump location 108 relative to the high wall 102.

Figure 5:
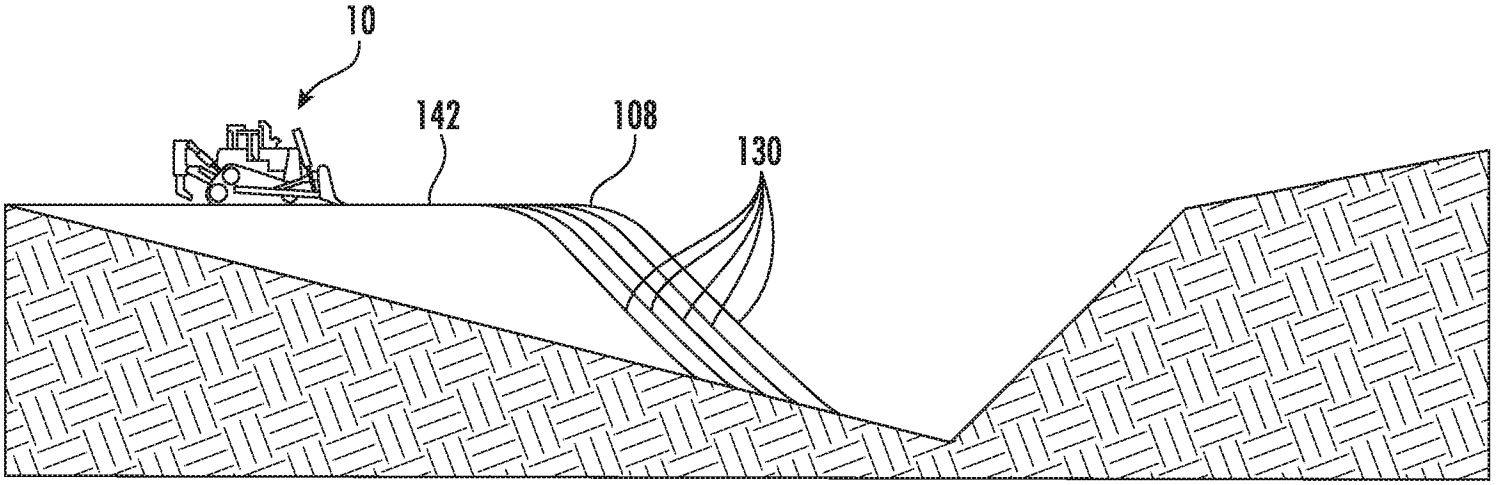
FIG. 5 depicts an enlarged diagrammatic cross-section of a portion of a work site illustrating the result of a plurality of tip head operations.

Referring to FIG. 5, a first process for spreading or dumping material involves pushing the material or overburden along the work surface until reaching a downward slope or crest. Upon reaching the crest, the overburden will fall down the slope along the crest. The process of dumping material over a crest and allowing the material to fall at the angle of repose due to gravity may sometimes be referred to as tip head dumping. In FIG. 5, examples of material dumped by a plurality of tip head dumping cycles are depicted schematically at 130.

As the material being pushed by machine 10 falls downward due to gravity, the load on the machine 10 and blade 16 will decrease. The change in terrain detection system 30 may utilize the implement load monitoring system 31 and/or any other system such as a perception system to generate change in terrain signals that indicate a change in terrain adjacent machine 10. Upon the change in terrain exceeding a change in terrain threshold, the controller 36 may generate command signals to move the machine 10 in reverse. The machine 10 may then be operated in reverse to back up along the path of operation until reaching the next cut location and the next sequential material moving operation performed.

Figure 6:
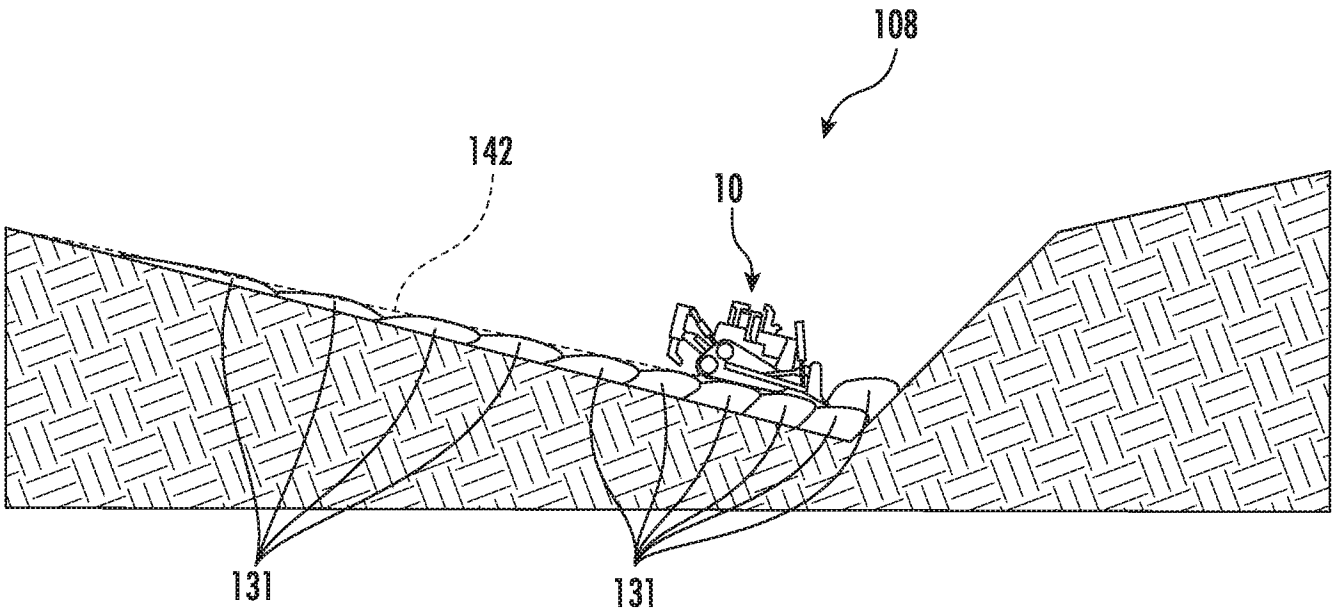
FIG. 6 depicts an enlarged diagrammatic cross-section of a portion of a work site illustrating the result of a plurality of backstacking operations.

Referring to FIG. 6, a second process for spreading or dumping material involves pushing the material or overburden along the work surface until reaching a desired end of travel location. Upon reaching the desired end of travel location, the machine 10 is operated in reverse which leaves a pile 131 of material on the work surface along which the machine is operating. The machine 10 is moved in reverse along the path of operation until reaching the next cut location and the next sequential material moving operation is performed.

In one embodiment, subsequent end of travel locations may be identified when the material being pushed by blade 16 engages the previously deposited pile 131 of material. Systems such as those used to monitor a change in terrain may detect when the material being pushed engages a previous pile 131 of material. More specifically, engagement or interaction of material being pushed with a previous pile 131 of material may be monitored by a change in load on the machine 10 and/or blade 16, deceleration of the machine, and/or a change in pitch angle of the machine. Other systems such as a perception system may be used in addition or in the alternative.

Control system 35 may include a module or planning system 37 for determining or planning various aspects of the excavation plan. The planning system 37 may receive and store various types of input such as the configuration of the work surface 104, the final design plane 112, a desired loading profile 121, a desired carry profile 122, and characteristics of the material to be moved. Operating characteristics and capabilities of the machine 10 such as maximum load may also be entered into the planning system 37.

In embodiments, the maximum load for a plurality of different operating conditions may be stored within the data map of the controller 36. For example, the maximum load that may be moved by the machine 10 may defined as a function of the volume of the blade 16 and, in one example, may depend on the characteristics (e.g., water content) of the material being moved. In another example, the maximum load may depend on the maximum slope along which the machine 10 is operating. For example, the machine 10 may not be able to push as much material when operating uphill as compared to downhill. Further, the machine 10 may have different maximum loads depending on whether the machine is performing a cutting operation or a carry operation. Based upon each of the foregoing, a maximum load may be determined.

The planning system 37 may simulate the results of cutting the work surface 104 at a particular cut location and for a particular target profile, and then choose a cut location that creates the most desirable results based on one or more criteria. The planning system 37 may determine the depth and location of each of the layers 113 to be removed. In addition, the planning system 37 may determine the sequential cut locations 115 along each layer 113 as well as the shape of the cuts or loading profile 114 through each layer. The planning system 37 may also be operative to plan other aspects of the material moving plan.

In embodiments, the planning function may be performed while operating the machine 10. In other embodiments, some or all aspects of the planning function may be performed ahead of time and the various inputs to the planning system 37 and the resultant cut locations, target profiles, and related data stored as part of the data maps of the controller 36.

During the planning process, the planning system 37 may divide the path 117 along each slot 110 into a plurality of increments 109 (FIG. 4) and data stored within controller 36 for each increment. The controller 36 may store information or characteristics of each increment 109 such as its position along the path, its elevation relative to a reference such as sea level, its angular orientation relative to a ground reference, and any other desired information. The information regarding each path 117 may be stored within an electronic map within the controller 36 as part of a topographical map of the work site 100. By dividing the path 117 into a plurality of increments 109, the analysis and planning process may be simplified by analyzing the characteristics at each increment.

Information regarding each path 117 may be obtained according to any desired method. In one example, the machine 10 may utilize the machine position sensing system 27 described above to map out the contour of work surface 104 as machine 10 moves across it. This data may also be obtained according to other methods such as by a vehicle that includes lasers and/or cameras. It should be noted that as the machine 10 moves material 105 to the dump location 108, the position or contour of the work surface 104 will change and may be updated based upon the current position of the machine 10 and the position of the blade 16.

As may be seen in FIG. 4, moving the blade 16 along the target profile 120 will result in a volume of material being moved from slot 110. The planning system 37 may use the shape of the loading profile 121 and the cut location 115 to determine the volume of material that would be moved by blade 16 if the machine 10 were to follow the target profile 120. More specifically, the planning system 37 may use three-dimensional data that is used to represent the machine 10, the work surface 104, and the target profile 120 to make a volumetric calculation of the volume of material that will be moved for a particular target profile 120.

Planning system 37 may be configured to determine a cut location in any of a plurality of manners. In one configuration, the planning system 37 may analyze potential cut locations along path 117 using an admissible heuristic process or technique. In doing so, the planning system 37 may perform a coarse analysis along the path 117 of the machine 10 to determine a start location for a more precise or fine analysis that is used to determine an optimized cut location.

The planning system 37 may analyze one or more parameters along the path 117 to determine an optimized cut location. In one embodiment, the parameter to be analyzed may be the amount of material to be moved at each potential cut location. The amount of material to be moved may be expressed in terms of volume, percentage of volume that the blade 16 may carry, percentage of load on the blade, or in any other desired manner. In other embodiments, alternative or additional parameters may be used.

When utilizing volume of material as the parameter, the planning system 37 may be configured to seek a cut location 115 in which the volume of material to be cut is a predetermined percentage of the maximum volume of the blade 16. In one embodiment, the loading percentage may be set at approximately 80%. In other embodiments, the loading percentage may be set at a lower volume such as approximately 70% and, in other embodiments, the loading percentage may be higher such as approximately 90%. It should be noted that during the analysis, the volume of material that may be moved may change based upon the slope of the path 117 along which the machine 10 is operating.

Figure 7:
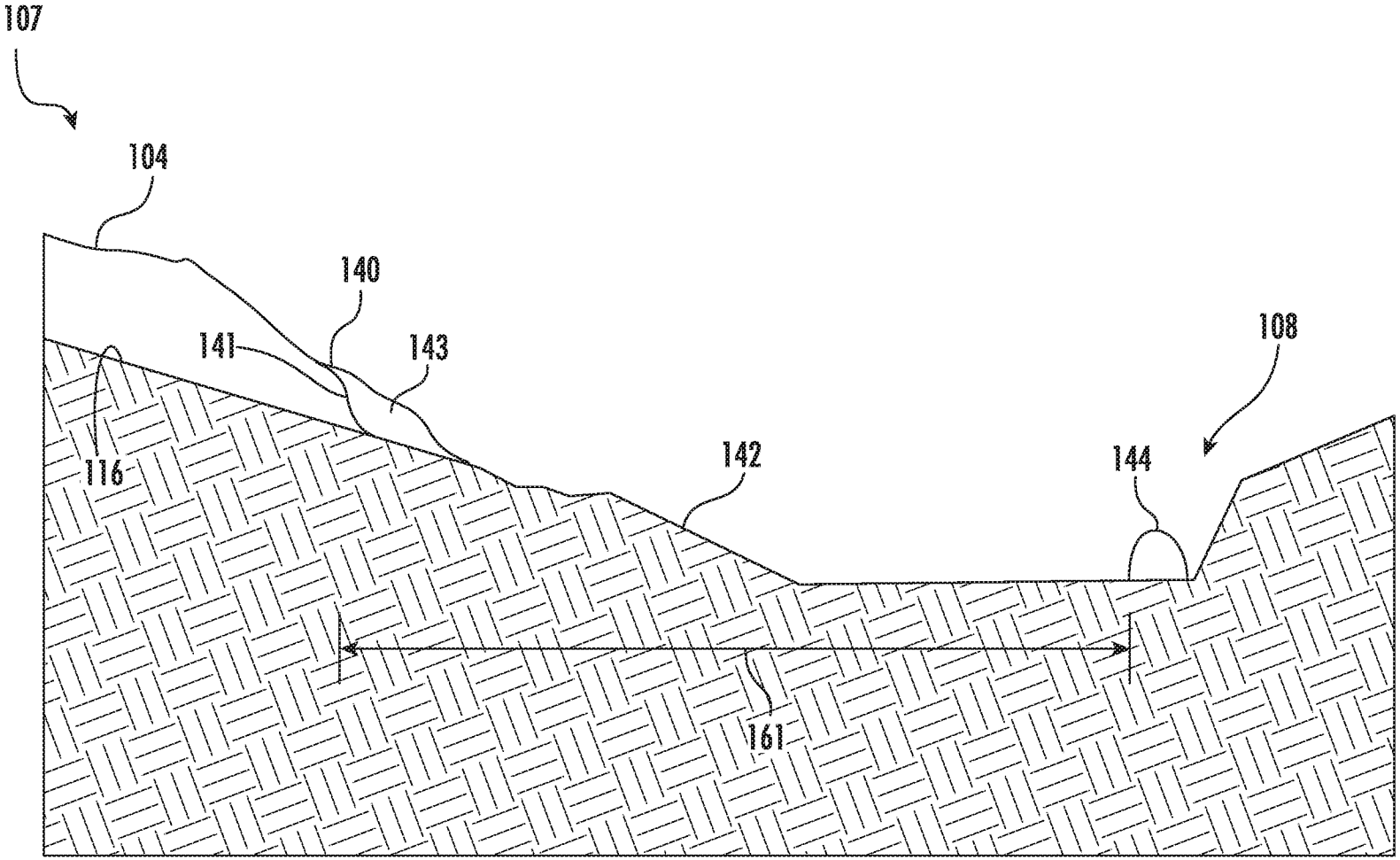
FIG. 7 depicts a diagrammatic cross-section of a portion of a work site illustrating a single cut operation.

Referring to FIG. 7, typical or traditional material cutting and carry operations are depicted with the material dumped or spread using a backstacking process. More specifically, during such operations, the machine 10 is positioned on the work surface 104 so that the tip 23 of the blade 16 is aligned with the desired cut location 140. The machine 10 is then propelled forward and downhill (from left to right in FIG. 7) with the tip 23 of the blade 16 cutting into and following the loading profile 147 to load the blade 16 and move material along the carry surface 142 until reaching the dump location. The machine 10 is then propelled in reverse until reaching the next cut location at which point the material moving operation is repeated.

The amount of material cut from the work surface 104 is first identified at 143 adjacent the cut location and the same material is identified again as a pile of material 144 formed as part of the backstacking process. In other words, the same material is depicted in FIG. 7 at its initial position at 143 prior to the cutting operation and at 144 after the carry operation has been completed. Since the material moving operation depicted in FIG. 7 includes only a single cut operation, the process is referred to herein as a "single cut operation" and the cut location 140 is referred to as a "single cut location."

In many instances, the maximum amount of material that may be cut during a cutting operation is 90% of the capacity or volume of the blade 16. Attempting to cut a greater amount of material may result in the machine 10 becoming stuck and/or cause excess wear on the machine. However, the machine 10 will typically have a substantially greater capacity to push or move material along the work surface 104 during the carry portion of a material moving operation (i.e., after the cutting operation). In some instances, this may be the result of the material being cut having been compacted as compared to material being carried and/or due to the nature of the cutting process. Whereas in one example the maximum amount of material that may be cut is 90% of the volume of the blade, the maximum amount of material that may be carried during the subsequent carrying operation may be 150% of the volume of the blade 16. Each of the percentages identified above may be affected by the characteristics of the material being moved and the maximum uphill slope encountered by the machine 10 during the relevant operation.

As may be understood from FIG. 7, after each load of material is cut from the work surface 104 and then carried to the dump location 108, the machine 10 operates in reverse to move back to the next single cut location. As described with respect to FIGS. 8-9, the planning system 37 disclosed herein is configured to generate cut locations and loading profiles that increase the amount of material that is carried during each carry operation. As a result, the number of carry operations required to move a specified total volume of material is reduced and as is the amount of time the machine is operated in reverse without pushing material. Such alternate cutting and carrying operations are referred to herein as a "double cut operation" as is explained in further detail below.

In operation, the planning system 37 determines a first double cut location 146 (FIG. 8) at which a volume of material is cut that is less than the maximum cutting capacity of the machine 10 and is approximately equal to one half of the maximum carrying capacity. Using the expected new or modified topography of the work surface as a result of the first double cut operation, the planning system 37 then determines a second double cut location 150 (FIG. 9) at which the volume of material that is cut is also less than the maximum cutting capacity of the machine 10 and is also approximately equal to one half of the maximum carrying capacity.

Although described in the example above with the volume of material equal to approximately one half of the carrying capacity of the machine 10, other volumes may be used. For example, the volume split between the first and second double cut operations does not need to be 50/50. The planning system 37 may select the first and second cutting locations so that a greater volume of material may be cut during either cutting operation so long as the volume does not exceed the cutting capacity of the machine 10. Further, the total volume cut by the first and second cutting operations does not need to equal the maximum capacity of the carrying operation. In some instances, it may be desirable to carry less than the maximum capacity.

Referring back to FIG. 8, the first stage of a double cut operation is depicted. The machine 10 is positioned on the work surface 104 so that the tip 23 of the blade 16 is aligned with a desired first double cut location 146. As discussed above, the first double cut location 146 may be selected by the planning system so that the volume of material moved by cutting at the first double cut location 146 and with a desired loading profile 147 results in the movement of a volume of material less than the maximum cutting capacity of the blade 16 and approximately half of the carrying capacity of the blade. Using the example above in which the maximum cutting capacity is 90% of the blade volume and the maximum carrying capacity is 150% of the blade volume, the first cut location 146 may be selected so that 75% of the capacity of the blade 16 will be cut.

Figure 8:
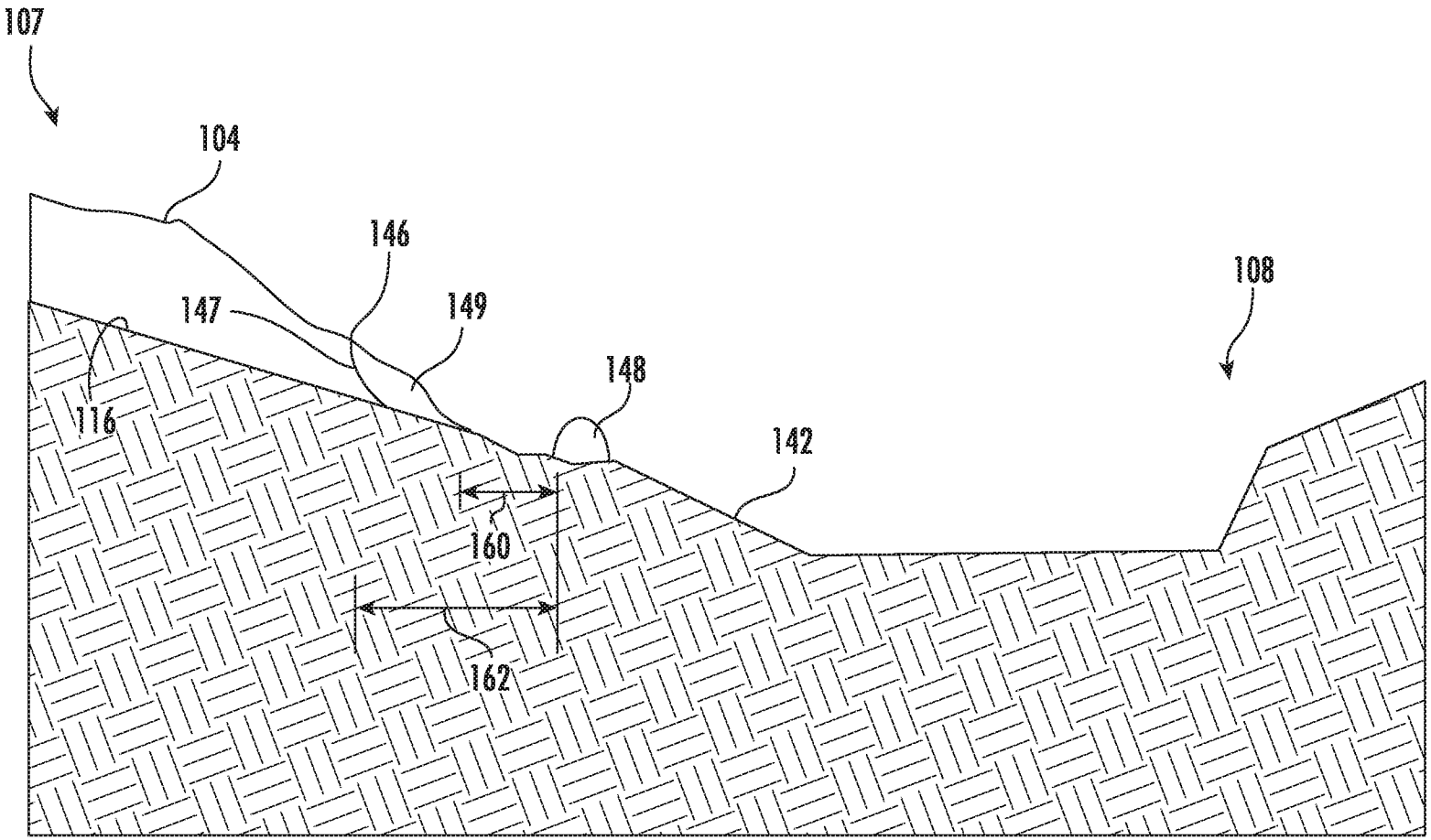
FIG. 8 depicts a diagrammatic cross-section of a portion of a work site illustrating a first phase of a double cut operation.

The machine 10 is then propelled forward and downhill with the tip 23 of the blade 16 cutting into the work surface 104 at the first double cut location 146 and following the loading profile 147 to load the blade 16 and move material along the carry surface 142 towards the dump location. Unlike the single cut operation described above, the machine 10 only travels partway towards the dump location 108 to an intermediate position between the first double cut location 146 and the dump location before being propelled in reverse to leave a pile of material 500 along the path but spaced from the first double cut location 146. In FIG. 8, the amount of material that is cut from the work surface 104 is first identified at 149 adjacent the first double cut location 146 and the same first double cut amount of material is identified again as the pile of material 148 somewhat downhill from the first double cut location.

The distance the machine 10 travels forward before stopping and operating in reverse is referred to herein as the double cut separation distance 160. The double cut separation distance 160 is intermediate the distance from the location where the blade 16 reaches the target surface 116 (i.e., where the machine 10 completes the cutting operation) to the location at which it stops moving forward. In embodiments, the double cut separation distance 160 may be approximately two times the length of the machine 10. Other distances are contemplated.

Figure 9:
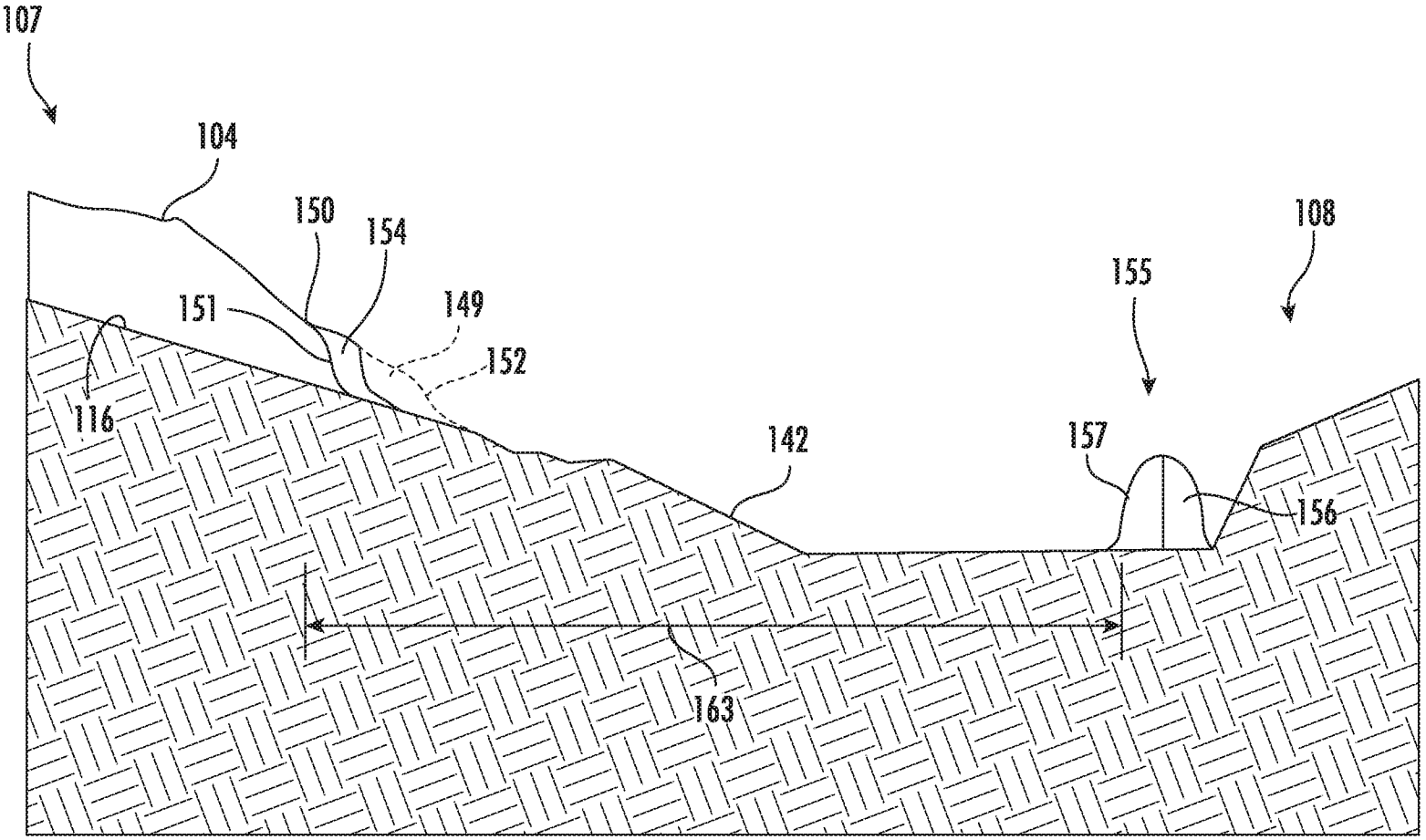
FIG. 9 depicts a diagrammatic cross-section of a portion of a work site illustrating a second phase of a double cut operation.

A first reversing operation is performed by propelling the machine 10 in reverse away and uphill from the pile of material 148 until the machine reaches a position on the work surface 104 at which the tip 23 of the blade 16 is aligned with the desired second double cut location 150 (FIG. 9). The second double cut location 150 may be selected by the planning system 37 so that the volume of material moved by cutting at the second double cut location (and after material has been removed by the first double cut operation) results in the movement of another 75% of the volume of the blade 16. As with the first double cut operation, the volume of material being cut by the blade 16 is less than the maximum cutting volume of the machine 10.

The machine 10 is then propelled forward and downhill with the tip 23 of the blade 16 cutting into the work surface 104 at the second double cut location 150 and following the loading profile 151 to load the blade 16 and move material along the carry surface 142 towards the dump location 108. The machine 10 travels partway towards the dump location 108 only partially loaded with material from the second double cut operation until it reaches the material left as the pile of material 148 from the first double cut operation. As the machine 10 continues in the forward and downhill direction, the blade pushes the pile of material 148 together with the material cut at the second double cut location 150 until it reaches the dump location 108.

A second reversing operation is performed by propelling the machine 10 in reverse away and uphill from the dump location 108 until the machine reaches a position on the work surface 104 at which the tip 23 of the blade 16 is aligned with the next cut location, at which point the next material moving operation (i.e., a single cut or double cut) is performed.

As depicted in FIG. 9, the amount of material cut from the work surface 104 in the first double cut operation adjacent the first double cut location 146 is identified at 149 uphill from the dotted line 152 that corresponds to the work surface prior to the first double cut operation. That same material is identified as a portion 156 of the pile of material 155 at the dump location 108. The amount of material that is cut from the work surface 104 in the second double cut operation adjacent the second double cut location 150 is identified at 154 and the same second double cut amount of material is identified as a portion 157 of the pile of material 155.

Although FIGS. 7-9 are depicted as using a backstacking dumping process, the single and double cut operations may be used with any type of dumping process such as the tip head dumping depicted in FIG. 5. Further, although the carry surface 142 is depicted as including downward and level surfaces in FIGS. 6-9, the carry surface may also include sections that extend upward. Thus, while a downward slope will increase the carrying capacity of the machine 10 as compared to a level surface, an upward slope will decrease the carrying capacity of the machine.

INDUSTRIAL APPLICABILITY

The industrial applicability of the planning system 37 described herein will be readily appreciated from the forgoing discussion. The foregoing discussion is applicable to systems in which one or more machines 10 are operated autonomously, semi-autonomously, or manually at a work site 100 to move material. Such system may be used at a mining site, a landfill, a quarry, a construction site, a roadwork site, a forest, a farm, or any other area in which movement of material is desired.

Figure 10:
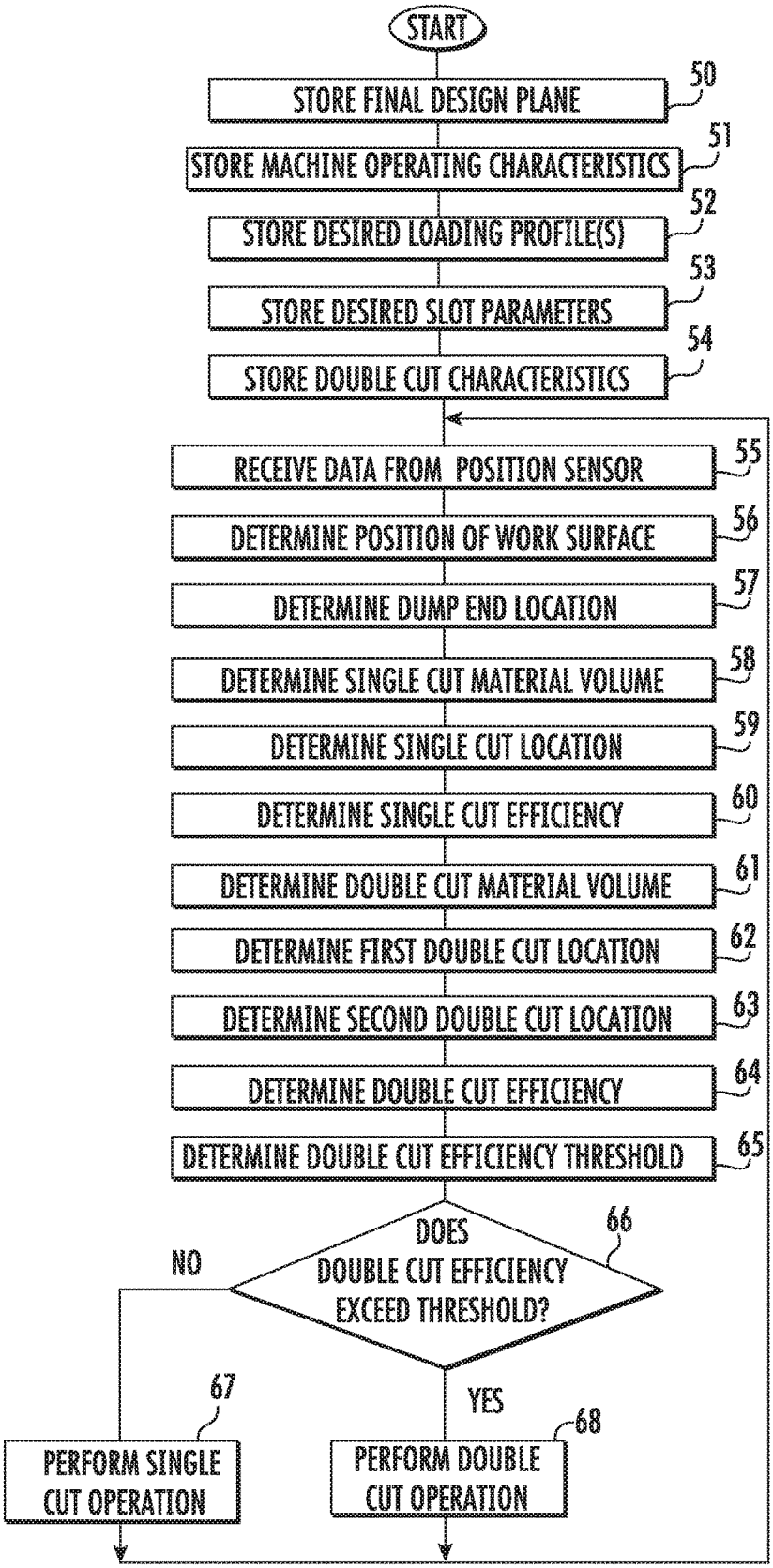
FIG. 10 depicts a flowchart illustrating a material moving process in accordance with the disclosure.

The flowchart of FIG. 10 depicts a material movement process in which the planning system 37 may determine an optimal location for a cut that forms a portion of a single cut operation or pair of cuts that form a portion of a double cut operation. At stage 50, the final design plane 112 may be set or stored within or entered into the controller. In one embodiment, the final design plane 112 may be entered by an operator or other personnel. In another embodiment, the final design plane 112 may be generated by the controller.

At stage 51, the operating characteristics of the machine 10 may be stored or set within the controller 36. The operating characteristics may include a desired load on the machine 10 and the dimensions of the machine. In embodiments, the operating characteristics of the machine may include the volume of material that can be moved during cut and carry operations as a function of the volume of the blade. The volume of material that can be moved may also be stored as a function of characteristics of the work site 100 including the maximum slope of the path along which the machine 10 is traveling, characteristics of the material being moved and/or any other desired characteristics.

One or more desired loading profiles of the target profile may be stored or set within the controller 36 at stage 52. As stated above, the loading profiles may have any desired configuration. At stage 53, the carry profile or slot parameters may be stored or set within the controller 36. The slot parameters may define the shape of the target surface 116, the depth of the carry surface below the work surface and each subsequent carry surface, the angle of the carry surface relative to a fixed reference, and the curvature of the carry surface.

At stage 54, double cut characteristics may be stored or set within the controller 36. The double cut characteristics may include a biasing factor and a double cut separation distance 160. The biasing factor may be used to determine whether to use a single cut or a double cut operation if the efficiencies of the two processes are similar. The double cut separation distance 160 may set the distance the machine 10 moves the material cut at the first double cut location 146.

The controller 36 may receive at stage 55 data from the position sensor 28. At stage 56, the controller 36 may determine the position or topography of the work surface 104 based upon the data from the position sensor 28.

At stage 57, the next dump end location may be accessed or determined. Regardless of whether the machine 10 is operating using a tip head dumping process or a backstacking process, the next dump end location may be determined, for example, based upon GPS coordinates, the previous dump end location, the terrain detection system 30 and/or any other desired sensors or systems.

At stage 58, the controller 36 may determine the desired volume of material to be moved using a single cut operation. In doing so, the controller 36 may analyze the characteristics of the material being moved and the profile or topography of the work surface 104 to determine the maximum volume of material that the machine 10 can cut.

At stage 59, the controller 36 may determine the next single cut location based upon the current profile or topography of the work surface 104 and the maximum volume of material the machine 10 can cut. For example, the controller 36 may analyze a plurality of potential cut locations and, based upon the current topography of the work surface 104 and/or the characteristics of the material, select a single cut location 140 and loading profile 141 that optimizes one or more operating characteristics. In one embodiment, the controller 36 may select the single cut location 140 to move a maximum amount of material in the most efficient manner possible. The maximum amount of material may be set to correspond to the maximum amount of material the machine 10 can cut.

The controller 36 may determine at stage 60 the efficiency of the single cut material moving operation $Eff_{singlecut}$ based upon the single cut location 140 selected by the controller. The single cut efficiency $Eff_{singlecut}$ may be determined based upon the volume of material moved divided by the distance that the machine 10 traveled to move that volume of material. More specifically, the single cut efficiency $Eff_{singlecut}$ may be expressed as:

$$Eff_{singlecut}=Vol_{singlecut}/2*Dist_{singlecut} \quad (1)$$

where $Vol_{singlecut}$ is the volume of material moved during the single cut operation, and $Dist_{singlecut}$ is the distance moved by the machine 10 during the single cut operation. As depicted at 161 in FIG. 7, $Dist_{singlecut}$ corresponds to the distance from the single cut location 140 to the edge of the pile of material 144 moved during the single cut operation. The $Dist_{singlecut}$ in the denominator of Equation (1) is multiplied by the numeral "2" to account for the distance the machine 10 moves in the forward direction from the single cut location 140 to the dump location 108 and the distance the machine moves in reverse from the dump location back to the next cut location.

At stage 61, the controller 36 may determine the volume of material to be moved using a double cut operation. In doing so, the controller 36 may analyze the characteristics of the material being moved and the profile or topography of the work surface to determine the maximum volume of material that the machine 10 can carry.

At stage 62, the controller 36 may determine the first double cut location 146 based upon the current profile or topography of the work surface 104 and the maximum volume of material that the machine 10 can carry. For example, the controller 36 may analyze a plurality of potential cut locations and, based upon the current topography of the work surface 104 and/or the characteristics of the material, select a first double cut location 146 and loading profile 147 that optimizes one or more operating characteristics. In one embodiment, the controller 36 may select the first double cut location 146 to move a desired amount of material in the most efficient manner possible. In one embodiment, the desired amount of material may be set to correspond to the half of the maximum amount of material the machine 10 can carry.

At stage 63, the controller 36 may determine the second double cut location 150 based upon the expected profile or topography of the work surface 104 as it would appear after the first double cut operation and the maximum volume of material that the machine 10 can carry. The controller 36 may analyze a plurality of potential cut locations and, based upon the expected topography of the work surface 104 after the expected first double cut operation and/or the characteristics of the material, select a second double cut location 150 and loading profile 151 that optimizes one or more operating characteristics. In one embodiment, the controller 36 may select the second double cut location 150 to move a desired amount of material in the most efficient manner possible. In one embodiment, the desired amount of material may be set to correspond to the half of the maximum amount of material the machine 10 can carry.

The controller 36 may determine at stage 64 the efficiency of the double cut material moving operation $Eff_{doublecut}$ based upon the double cut locations 146, 150 selected by the controller. The double cut efficiency $Eff_{doublecut}$ may be determined based upon the volume of material moved divided by the distance that the machine 10 traveled to move that volume of material. More specifically, the double cut efficiency $Eff_{doublecut}$ may be expressed as:

$$Eff_{doublecut}=Vol_{doublecut}/(2*Dist_{doublecut1}+Dist_{doublecut2}) \quad (2)$$

where $Vol_{doublecut}$ is the total volume of material moved during the double cut operation In other words, the volume of material moved during the first double cut operation plus the volume of material moved during the second double cut operation. $Dist_{doublecut1}$ is the distance moved by the machine 10 during the first double cut operation. As depicted at 162 in FIG. 8, $Dist_{doublecut1}$ is the distance from the first double cut location 146 to the location of the pile of material 148. As depicted at 163 in FIG. 9, $Dist_{doublecut2}$ is the distance from the second double cut location 150 to the dump location for the entire pile of material 155. The $Dist_{doublecut1}$ and $Dist_{doublecut2}$ in the denominator of Equation (2) is multiplied by the numeral "2" to account for the distance the machine 10 moves in the forward direction from each of the double cut locations 146, 150 and the distance the machine moves in reverse from the first pile of material 148 and the second pile of material 155, respectively, back to the next cut location.

In some embodiments, the single cut efficiency $Eff_{singlecut}$ may be multiplied by a biasing factor $Bias_{doublecut}$ to determine a double cut efficiency threshold $Threshold_{doublecut}$ at stage 65. The biasing factor $Bias_{doublecut}$ may be used to determine which cutting operation (i.e., single cut or double cut) to use if the efficiencies are of the two operations are similar or close. More specifically, the double cut efficiency threshold $\text{Threshold}_{doublecut}$ may be expressed as:

$$\text{Threshold}_{doublecut}=\text{Eff}_{singlecut}*\text{Bias}_{doublecut} \quad (3)$$

In an embodiment in which the biasing factor $\text{Bias}_{doublecut}$ is equal to 1.0, the controller 36 may select the cutting operation based upon whichever has the highest efficiency. In other embodiments, the biasing factor $\text{Bias}_{doublecut}$ may be set at greater than 1.0 so that the controller 36 may utilize the single cut operation unless the double cut operation is more efficient than the single cut operation. In an example, the biasing factor biasing factor $\text{Bias}_{doublecut}$ may be set at greater than 1.1 so that the controller 36 may utilize the single cut operation unless the double cut operation at least 10% more efficient than the single cut operation.

At stage 66, the controller 36 may determine whether the double cut efficiency $\text{Eff}_{doublecut}$ exceeds the double cut efficiency threshold $\text{Threshold}_{doublecut}$. If the double cut efficiency $\text{Eff}_{doublecut}$ does not exceed the double cut efficiency threshold $\text{Threshold}_{doublecut}$, the controller 36 may generate at stage 67 a single cut operating command to perform a single cut operation. When operating autonomously, the controller 36 may generate operating commands to move the machine 10 so that the tip 23 of the blade 16 is aligned with the single cut location 140. Further commands may be generated to propel the machine 10 forward with the tip 23 of the blade 16 following the loading profile 141 and moving the material to the dump location 108. Upon reaching the dump location 108, the machine 10 may be propelled in reverse to move the machine to the next cut location and then repeating stages 55-68. In embodiments, stage 55 may be performed while the machine is operating in reverse. In other embodiments, stage 55 may be performed while the machine 10 is moving towards the dump location 108. If desired, the analysis of stages 56-68 may be performed while the machine is being propelled in reverse. When operating semi-autonomously, the controller 36 may autonomously perform some but not all of the operations for the single cut operation.

If the double cut efficiency $\text{Eff}_{doublecut}$ exceeds the double cut efficiency threshold $\text{Threshold}_{doublecut}$ the controller 36 may generate at stage 68 a double cut operating command to perform a double cut operation. When operating autonomously, the controller 36 may generate operating commands to move the machine 10 so that the tip 23 of the blade 16 is aligned with the first double cut location 146. Further commands may be generated to propel the machine forward with the tip 23 of the blade 16 following the loading profile 147 and moving the material towards the dump location 108.

Upon traveling the double cut separation distance 160 after the blade 16 has reached the carry surface 142, further commands may be generated to propel the machine in reverse until the tip 23 of the blade is aligned with the second double cut location 150. Further commands may be generated to propel the machine forward with each tip 23 of the blade following the loading profile 151 and moving the material towards the dump location 108. Upon reaching the pile of material 148 moved during the first double cut operation, the machine 10 will carry material from both the first and second double cut operations to the dump location 108. Upon reaching the dump location 108, the machine 10 may be propelled in reverse to move the machine to the next cut location and then repeating stages 55-68. In embodiments, stage 55 may be performed while the machine is operating in reverse. In other embodiments, stage 55 may be performed while the machine 10 is moving towards the dump location 108. If desired, the analysis of stages 56-68 may be performed while the machine is being propelled in reverse. When operating semi-autonomously, the controller 36 may autonomously perform some but not all of the operations for the double cut operation.

Various alternatives are contemplated. For example, as described above, rather than splitting the volume of material equally between the first and second double cut operations, the volume may be split in other ratios. Further, although the efficiencies of the single and double cut operations are calculated above based upon the distance traveled by the machine 10, the efficiencies could be calculated in other manners such as based upon other operating parameters associated with the material moving operations including the travel time or fuel consumption for each process.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for moving material with a machine at a work site with a ground engaging work implement along a path from a first work area to a dump location, comprising:

a position sensor for generating position signals indicative of a position of a work surface; and a controller configured to:

receive position signals from the position sensor;

determine a topography of the work surface based upon the position signals;

determine a maximum cutting capacity for a cutting operation between the work surface and a target surface beneath the work surface;

determine a maximum carrying capacity for a carrying operation along a carry surface from an end of a loading profile to the dump location;

determine a first double cut location of a double cut operation along the work surface based upon the maximum carrying capacity and the topography of the work surface, and the first double cut location, the topography, and a first loading profile defining a first double cut amount of material to be moved;

determine a second double cut location of the double cut operation based upon the maximum carrying capacity and a modified topography of the work surface, the modified topography of the work surface being based upon the first double cut location and the topography of the work surface, and the second double cut location, the modified topography, and a second loading profile defining a second double cut amount of material to be moved;

each of the first double cut amount of material and the second double cut amount of material being less than the maximum cutting capacity between the work surface and the target surface, and the first double cut amount of material plus the second double cut amount of material being less than the maximum carrying capacity along the carry surface;

generate a first forward command to move the ground engaging work implement along the path and the first loading profile from the first double cut location and only partway towards the dump location to an intermediate position between the first double cut location and the dump location to move the first double cut amount of material to the intermediate position;

generate a first reverse command to move the machine along the path to align the ground engaging work implement with the second double cut location; and generate a second forward command to move the ground engaging work implement along the path and the second loading profile from the second double cut location to the dump location to move the first double cut amount of material and the second double cut amount of material to the dump location.

2. The system of claim 1, wherein the maximum carrying capacity is a volume of material.

3. The system of claim 2, wherein the maximum carrying capacity is a percentage of volume of the ground engaging work implement.

4. The system of claim 3, wherein the maximum cutting capacity is a volume of material.

5. The system of claim 1, wherein the second forward command moves the first double cut amount of material from the intermediate location to the dump location and the second double cut amount of material from a position adjacent the second double cut location to the dump location.

6. The system of claim 1, wherein the controller is further configured to determine a maximum slope along the carry surface and the maximum carrying capacity is based upon the maximum slope.

7. The system of claim 1, wherein the controller is further configured to set characteristics of the material to be moved and the maximum carrying capacity is based upon the characteristics of the material.

8. The system of claim 1, wherein the controller is further configured to determine a position of the dump location along the path.

9. The system of claim 1, wherein the controller is further configured to access the intermediate position.

10. The system of claim 1, wherein the controller is further configured to:

determine a single cut location of a single cut operation along the work surface based upon the maximum cutting capacity and the topography of the work surface, and the single cut location, the topography, and a single cut loading profile defining a single cut amount of material to be moved;

determine a single cut efficiency of the single cut operation corresponding to the single cut location, the single cut efficiency being based upon the single cut amount of material to be moved and a single cut operating parameter associated with the single cut operation;

determine a double cut efficiency of the double cut operation corresponding to the first double cut location and the second double cut location, the double cut efficiency being based upon the first double cut amount of material to be moved and the second double cut amount of material to be moved and a double cut operating parameter associated with the double cut operation;

generate a single cut operating command to operate the machine and perform a single cut operation upon the double cut efficiency being less than the single cut efficiency times a biasing factor; and generate a double cut operating command to operate the machine and perform a double cut operation upon the double cut efficiency being greater than the single cut efficiency times a biasing factor.

11. The system of claim 10, wherein the biasing factor is greater than 1.0.

12. The system of claim 10, wherein the biasing factor is 1.1 or greater.

13. The system of claim 10, wherein the single cut operating parameter is a distance between the single cut location and the dump location and the double cut operating parameter is a distance between the first double cut location and the intermediate position plus a distance from the second double cut location to the dump location.

14. The system of claim 1, further including a machine position sensor for generating machine position signals indicative of a position of the machine, and the controller is configured to determine the position of the machine and determine a position of the ground engaging work implement based upon the position of the machine.

15. A method of moving material with a machine at a work site with a ground engaging work implement, the machine moving on a work surface along a path from a first work area to a dump location, comprising:

receiving position signals from a position sensor;

determining a topography of the work surface based upon the position signals;

determining a maximum cutting capacity for a cutting operation between the work surface and a target surface beneath the work surface;

determining a maximum carrying capacity for a carrying operation along a carry surface from an end of a loading profile to the dump location;

determining a first double cut location of a double cut operation along the work surface based upon the maximum carrying capacity and the topography of the work surface, and the first double cut location, the topography, and a first loading profile defining a first double cut amount of material to be moved;

determining a second double cut location of the double cut operation based upon the maximum carrying capacity and a modified topography of the work surface, the modified topography of the work surface being based upon the first double cut location and the topography of the work surface, and the second double cut location, the modified topography, and a second loading profile defining a second double cut amount of material to be moved;

each of the first double cut amount of material and the second double cut amount of material being less than the maximum cutting capacity between the work surface and the target surface, and the first double cut amount of material plus the second double cut amount of material being less than the maximum carrying capacity along the carry surface;

generating a first forward command to move the ground engaging work implement along the path and the first loading profile from the first double cut location and only partway towards the dump location to an intermediate position between the first double cut location and the dump location to move the first double cut amount of material to the intermediate position;

generating a first reverse command to move the machine along the path to align the ground engaging work implement with the second double cut location; and generating a second forward command to move the ground engaging work implement along the path and the second loading profile from the second double cut location to the dump location to move the first double cut amount of material and the second double cut amount of material to the dump location.

16. The method of claim 15, further comprising:

determining a single cut location of a single cut operation along the work surface based upon the maximum cutting capacity and the topography of the work surface, and the single cut location, the topography, and a single cut loading profile defining a single cut amount of material to be moved;

determining a single cut efficiency of the single cut operation corresponding to the single cut location, the single cut efficiency being based upon the single cut amount of material to be moved and a single cut operating parameter associated with the single cut operation;

determining a double cut efficiency of the double cut operation corresponding to the first double cut location and the second double cut location, the double cut efficiency being based upon the first double cut amount of material to be moved and the second double cut amount of material to be moved and a double cut operating parameter associated with the double cut operation;

generating a single cut command to operate the machine and perform a single cut operation upon the double cut efficiency being less than the single cut efficiency times a biasing factor; and generating a double cut command to operate the machine and perform a double cut operation upon the double cut efficiency being greater than the single cut efficiency times a biasing factor.

17. The method of claim 16, wherein the biasing factor is 1.1 or greater.

18. The method of claim 15, further including determining a maximum slope along the carry surface and the maximum carrying capacity is based upon the maximum slope.

19. The method of claim 15, further including setting characteristics of the material to be moved and the maximum carrying capacity is based upon the characteristics of the material.

20. A machine, comprising:

a prime mover;

a ground-engaging work implement for engaging a work surface along a path;

a position sensor for generating position signals indicative of a position of a work surface; and a controller configured to:

receive position signals from the position sensor;

determine a topography of the work surface based upon the position signals;

determine a maximum cutting capacity for a cutting operation between the work surface and a target surface beneath the work surface;

determine a maximum carrying capacity for a carrying operation along a carry surface from an end of a loading profile to a dump location;

determine a first double cut location of a double cut operation along the work surface based upon the maximum carrying capacity and the topography of the work surface, and the first double cut location, the topography, and a first loading profile defining a first double cut amount of material to be moved;

determine a second double cut location of the double cut operation based upon the maximum carrying capacity and a modified topography of the work surface, the modified topography of the work surface being based upon the first double cut location and the topography of the work surface, and the second double cut location, the modified topography, and a second loading profile defining a second double cut amount of material to be moved;

each of the first double cut amount of material and the second double cut amount of material being less than the maximum cutting capacity between the work surface and the target surface, and the first double cut amount of material plus the second double cut amount of material being less than the maximum carrying capacity along the carry surface;

generate a first forward command to move the ground engaging work implement along the path and the first loading profile from the first double cut location and only partway towards the dump location to an intermediate position between the first double cut location and the dump location to move the first double cut amount of material to the intermediate position;

generate a first reverse command to move the machine along the path to align the ground engaging work implement with the second double cut location; and generate a second forward command to move the ground engaging work implement along the path and the second loading profile from the second double cut location to the dump location to move the first double cut amount of material and the second double cut amount of material to the dump location.

* * * * *